US008558768B2

(12) United States Patent
Tanikame

(10) Patent No.: US 8,558,768 B2
(45) **Date of Patent: *Oct. 15, 2013**

(54) PIXEL CIRCUIT, DISPLAY DEVICE, AND ELECTRONIC APPLIANCE

(75) Inventor: Takao Tanikame, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/618,825

(22) Filed: Sep. 14, 2012

(65) Prior Publication Data

US 2013/0009936 A1 Jan. 10, 2013

Related U.S. Application Data

(63) Continuation of application No. 12/585,923, filed on Sep. 29, 2009, now Pat. No. 8,325,169.

(30) Foreign Application Priority Data

Nov. 7, 2008 (JP) ..... 2008-286782

(51) Int. Cl.
*G09G 3/30* (2006.01)

(52) U.S. Cl.
USPC ..... 345/78; 345/76; 345/82

(58) Field of Classification Search
None
See application file for complete search history.

(56) References Cited

U.S. PATENT DOCUMENTS

| | | | | |
|---|---|---|---|---|
| 7,071,932 | B2 * | 7/2006 | Libsch et al. | 345/211 |
| 7,564,433 | B2 | 7/2009 | Hector et al. | |
| 2007/0103406 | A1 | 5/2007 | Kim | |

FOREIGN PATENT DOCUMENTS

| | | | |
|---|---|---|---|
| JP | 2005-099773 | A | 4/2005 |
| JP | 2005-157308 | A | 6/2005 |
| JP | 2006-184846 | A | 7/2006 |
| JP | 2006-189874 | A | 7/2006 |
| JP | 2007-133369 | | 5/2007 |

OTHER PUBLICATIONS

Japanese Office Action Issued Mar. 5, 2013 for corresponding Japanese Application No. 2008-286782.

* cited by examiner

*Primary Examiner* — Joseph Haley
(74) *Attorney, Agent, or Firm* — Rader, Fishman & Grauer PLLC

(57) ABSTRACT

A pixel circuit provided on a substrate on which a signal line, first and second scanning lines supplying first and second control pulse signals, a fixed power line, and a variable power line are arranged includes a capacitance element, a sampling transistor connected between the signal line and one of ends of the capacitance element, where the gate of the sampling transistor is connected to the first scanning line, a drive transistor of which gate is connected to the other end, where one of a drain and a source of the drive transistor is connected to the fixed power line, an initializing transistor of which gate is connected to the second scanning line, which is connected between the other end and the other of the drain and the source, and a light emitting element connected between the variable power line and the other of the drain and the source.

7 Claims, 14 Drawing Sheets

PIXEL CIRCUIT, DISPLAY DEVICE, AND ELECTRONIC APPLIANCE

CROSS REFERENCES TO RELATED APPLICATIONS

This is a Continuation Application of U.S. patent application Ser. No. 12/585,923, filed Sep. 29, 2009, which claims priority from Japanese Patent Application JP 2008-286782 filed in the Japan Patent Office on Nov. 7, 2008, the entire contents of which being incorporated herein by reference.

BACKGROUND OF THE INVENTION

1. Field of the Invention

The present invention relates to a pixel circuit driving a light emitting element through a transistor, a display device including a plurality of the above-described pixel circuits arranged in matrix form so as to display an image, and an electronic appliance incorporating the above-described display device.

2. Description of the Related Art

A pixel circuit driving a light emitting element through a transistor is disclosed in Japanese Unexamined Patent Application Publication No. 2007-133369, for example. The pixel circuit is provided on a substrate on which at least one signal line supplying a video signal and at least one scanning line supplying a control pulse signal are arranged. The pixel circuit basically includes a sampling transistor, a drive transistor, and a light emitting element. The sampling transistor is turned on in response to the control pulse signal supplied from the scanning line and captures the video signal supplied from the signal line. The drive transistor supplies a drive current to the light emitting element based on the captured video signal. The light emitting element emits light due to the drive current, where the light has brightness determined based on the video signal.

SUMMARY OF THE INVENTION

According to pixel circuits used in the past, a thin-film transistor is provided on a substrate through a semiconductor process. The threshold voltage of the thin-film transistor exhibits a variation. If the threshold voltage of a drive transistor driving a light emitting element based on a video signal exhibits a variation, the brightness of the emitted light varies so that the uniformity of a screen image of a display device is reduced.

The pixel circuits used in the past incorporate a function of correcting a variation in the threshold voltage of a drive transistor (threshold voltage correction function). However, an additional transistor should be provided to incorporate the threshold voltage correction function into the pixel circuit. The pixel circuit disclosed in Japanese Unexamined Patent Application Publication No. 2007-133369 includes an aggregate of six transistors. When many transistors are integrated and provided in the pixel circuit, it becomes difficult to reduce the pixel size, which raises a problem to be solved to achieve a high precision display device.

Accordingly, the present invention has been achieved to present a pixel circuit implementing the threshold voltage correction function through the use of a small number of transistor devices. Therefore, a pixel circuit according to an embodiment of the present invention is provided on a substrate on which a signal line in which a signal potential and a reference potential are alternately switched, a first scanning line supplying a first control pulse signal, a second scanning line supplying a second control pulse signal, a fixed power line, and a variable power line switched between a first potential and a second potential are arranged, where the pixel circuit includes a capacitance element, a sampling transistor connected between the signal line and one of ends of the capacitance element, where a gate of the sampling transistor is connected to the first scanning line, a drive transistor of which gate is connected to the other end of the capacitance element, where one of a drain and a source of the drive transistor is connected to the fixed power line, an initializing transistor of which gate is connected to the second scanning line, where the initializing transistor is connected between the other end of the capacitance element and the other of the drain and the source of the drive transistor, and a light emitting element connected between the variable power line and the other of the drain and the source of the drive transistor.

Preferably, when the variable power line is held at the first potential, the signal potential is supplied to one of the ends of the capacitance element via the sampling transistor while the initializing transistor is turned on, wherein the initializing transistor is turned off while the reference potential is supplied to one of the ends of the capacitance element via the sampling transistor, and wherein the sampling transistor is turned off while the variable power line is switched from the first potential to the second potential. Further, when the variable power line is held at the first potential and the signal line is held at the signal potential, the sampling transistor is turned on while the initializing transistor is turned on, wherein the initializing transistor is turned off while the signal line is switched from the signal potential to the reference potential, and wherein the sampling transistor is turned off while the variable power line is switched from the first potential to the second potential.

According to an embodiment of the present invention, the pixel circuit includes the sampling transistor, the drive transistor, and the initializing transistor. The number of the transistor devices is significantly reduced so as to reduce the size of the pixel circuit. Thus, the threshold voltage correction function is incorporated into the pixel circuit even though the pixel circuit is reduced in size, which makes it possible to reduce a variation in the brightness of the light emitting element.

DESCRIPTION OF THE PREFERRED EMBODIMENT

Hereinafter, best modes (hereinafter referred to as embodiments) for performing the present invention will be described. The description will be given in the order a reference, an embodiment, and an application.

Reference

[General Configuration]

Figure 1A:
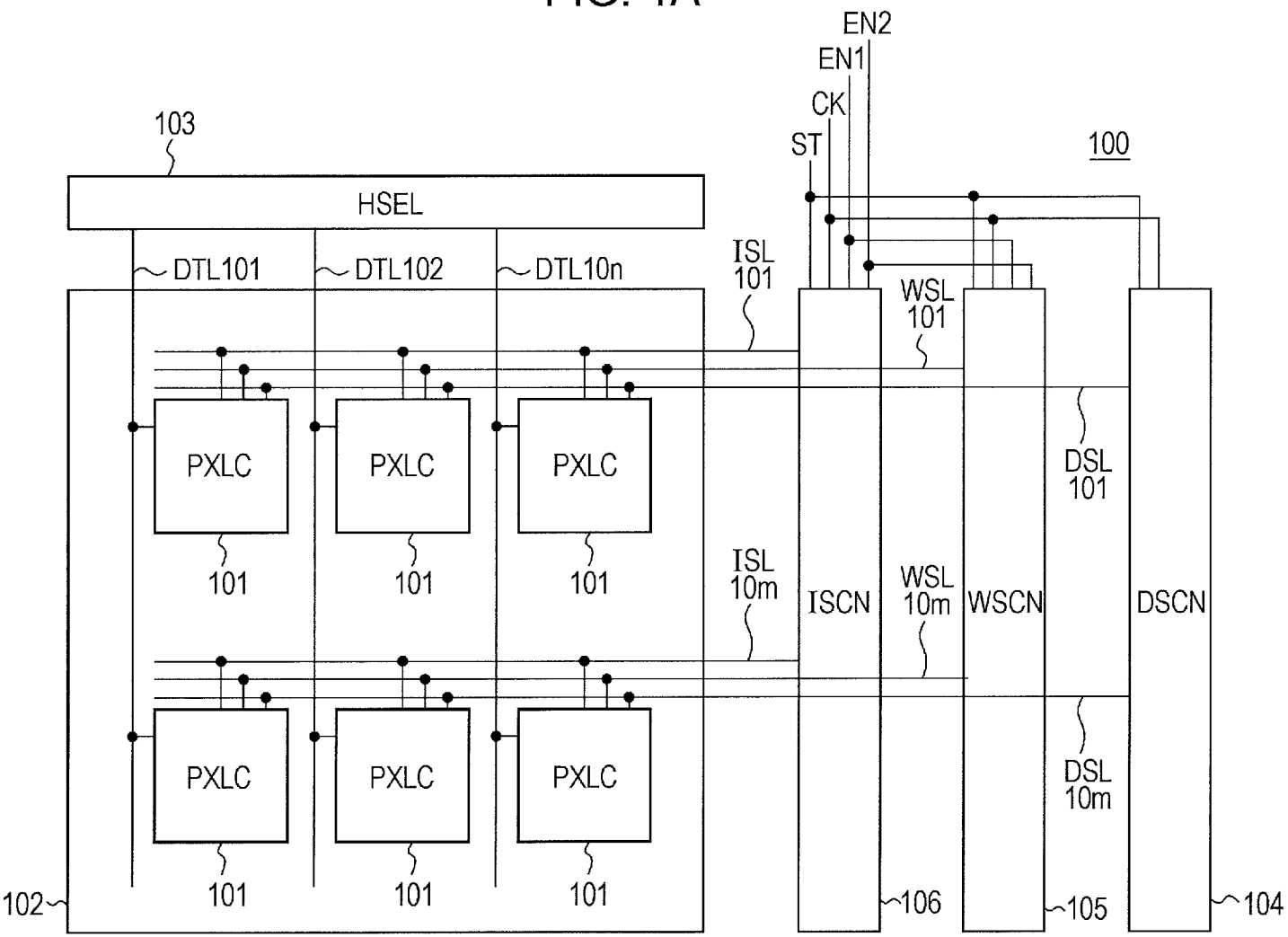
FIG. 1A is a block diagram showing the entire configuration of a display device according to a reference.

FIG. 1A is a general block diagram of a display device 100 provided as a reference clarifying the background of the present invention. The present invention corresponds to a modification of the above-described reference. As shown in FIG. 1A, the above-described display device 100 basically includes a pixel array portion 102 and a driving portion. The pixel array portion 102 includes first line-like scanning lines WSL and second line-like scanning lines ISL. Further, third scanning lines DSL are provided in parallel with the above-described scanning lines WSL and ISL. For identifying each of the scanning lines WSL, ISL, and DSL, the scanning lines WSL, ISL, and DSL are designated by reference numerals 101 to 10*m*, where the sign m denotes the line number.

The pixel array portion 102 further includes file-like signal lines DTL. For identifying each of the signal lines DTL, the signal lines DTL are designated by reference numerals 101 to 10*n*, where the sign n denotes the file number. Further, the pixel array portion 102 includes pixels (PXLC) 101 that are provided in matrix form, where each of the PXLCs 101 is provided at a part where the line-like scanning line WSL and the file-like signal line DTL cross each other. The above-described pixel array portions 102 are integrated and provided on a substrate.

On the other hand, the driving portion provided around the pixel array portion 102 includes a power scanner (DSCN) 104, a write scanner (WSCN) 105, an initializing scanner (ISCN) 106, a horizontal selector (HSEL) 103, and so forth.

The write scanner 105 scans the scanning lines WSL 101 to 10*m* in sequence, and transmits the first control pulse signal to each of the scanning lines WSL 101 to 10*m*. The initializing scanner 106 transmits the second control pulse signals to the second scanning lines ISL 101 to ISL 10*m* in synchronization with the sequential line scanning performed by the write scanner 105. The power scanner 104 transmits the third control pulse signals to the third scanning lines DSL 101 to DSL 10*m* in sequence in synchronization with the sequential line scanning. Each of the write scanner 105, the initializing scanner 106, and the power scanner 104 includes a shift register, and a start pulse signal ST and a clock signal CK are externally transmitted to each of the shift registers so that the shift registers can operate in synchronization with one another. Further, enable signals EN1 and EN2 are externally transmitted to each of the shift registers so as to shape the waveform of the first control pulse signal and/or the second control pulse signal.

On the other hand, the horizontal selector 103 transmits a video signal to each of the signal lines DTL 101 to DTL 10*n* in synchronization with the sequential line scanning performed on the part of the scanners 104, 105, and 106.

[Circuit Configuration of Pixel]

Figure 1B:
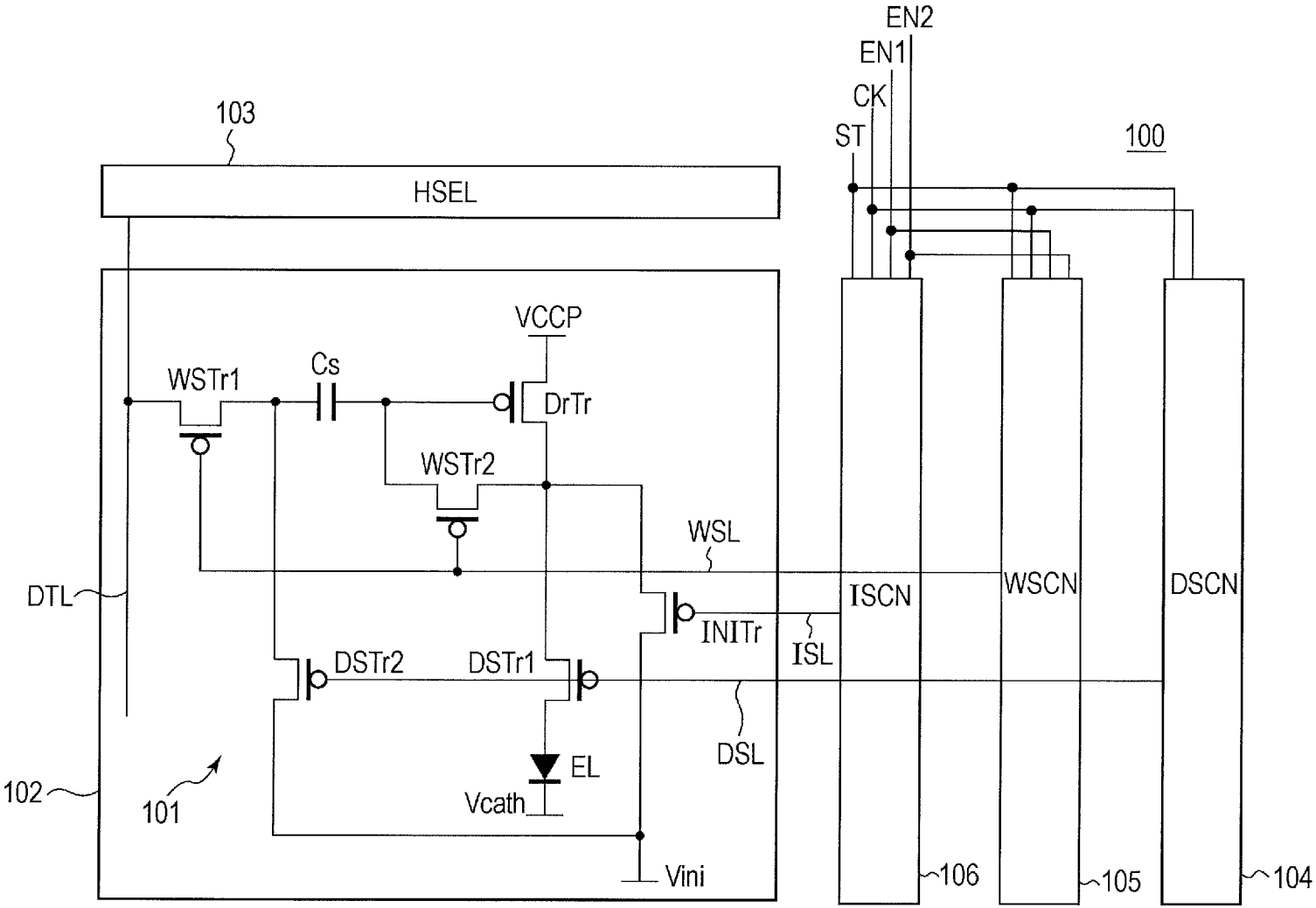
FIG. 1B is a circuit diagram showing the configuration of a pixel according to the reference.

FIG. 1B is a circuit diagram indicating the configuration of a pixel circuit 101 included in the pixel array portion 102 of the display device 100 shown in FIG. 1A. As shown in FIG. 1B, the pixel circuit 101 includes six transistors including the first and second sampling transistor WSTr1 and WSTr2, a drive transistor DrTr, an initializing transistor INITr, the first and second switching transistors DSTr1 and DSTr2, a single light emitting element EL, and a single capacitance element (pixel capacitance) Cs. Each of the six transistors is provided as a P-channel transistor.

A pair of control ends (a source and a drain) of the first sampling transistor WSTr1 are connected between the signal line DTL and the input end of the pixel capacitance Cs. The control end (gate) of the first sampling transistor WSTr1 is connected to the first scanning line WSL.

The control end (gate) of the drive transistor DrTr is connected to the output end of the pixel capacitance Cs. The other current end (source) of the drive transistor DrTr is connected to a power line VCCP.

A pair of current ends of the second sampling transistor WSTr2 is connected between the output end of the pixel capacitance Cs and the other current end (drain) of the drive transistor DrTr. The control end of the second sampling transistor WSTr2 is connected to the first scanning line WSL. In other words, the first and second sampling transistors WSTr1 and WSTr2 are ON/OFF-controlled through the scanning line WSL at the same time.

A pair of current ends of the initializing transistor INITr is connected between the drain of the drive transistor DrTr and an initializing potential Vini. The control end of the initializing transistor INITr is connected to the second scanning line ISL.

One of current ends of the first switching transistor DSTr1 is connected to the drain of the drive transistor DrTr, and the other current end is connected to the anode of the light emitting element EL. The cathode of the light emitting element EL is connected to a cathode potential Vcath. The control end (gate) of the first switching transistor DSTr1 is connected to the third scanning line DSL.

One of current ends of the second switching transistor DSTr2 is connected to the input end of the pixel capacitance Cs, and the other current end is connected to the initializing potential Vini. The gate of the second switching transistor DSTr2 is connected to the third scanning line DSL. Consequently, both the second switching transistor DSTr2 and the first switching transistor DSTr1 perform an ON/OFF operation in response to the third control pulse signal transmitted from the third scanning line DSL.

Figure 2A:
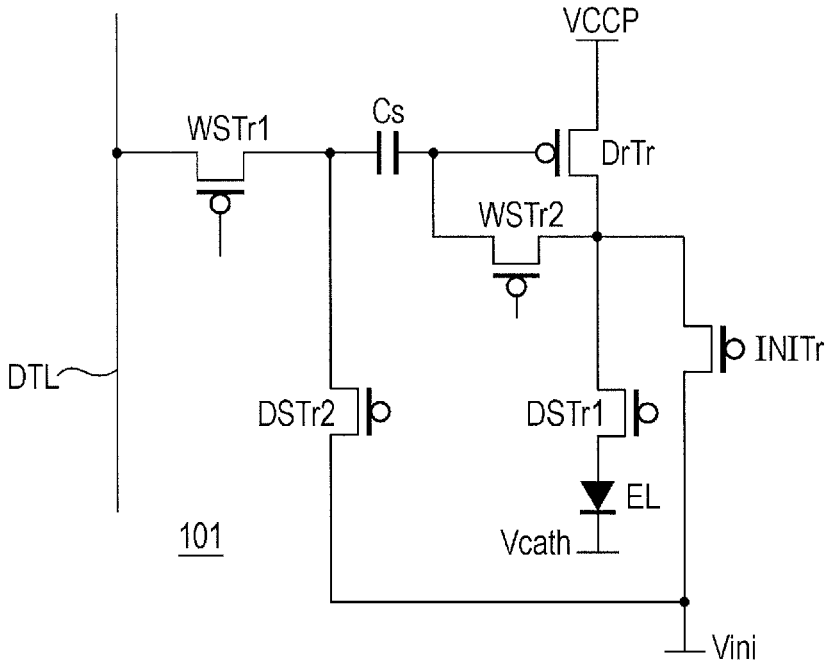
FIG. 2A is a pixel circuit diagram according to the reference.

FIG. 2A is a circuit diagram schematically showing one of pixel circuits 101 that are provided in the display device 100 shown in FIG. 1B. Hereinafter, the operations of the pixel circuit 101 will be described in detail based on the above-described circuit diagram. Basically, the pixel circuit 101 shown in FIG. 2A performs an initializing operation, a threshold-voltage correction operation, a preparatory operation, and a light-emitting operation during a single field in a predetermined sequence.

Figure 2B:
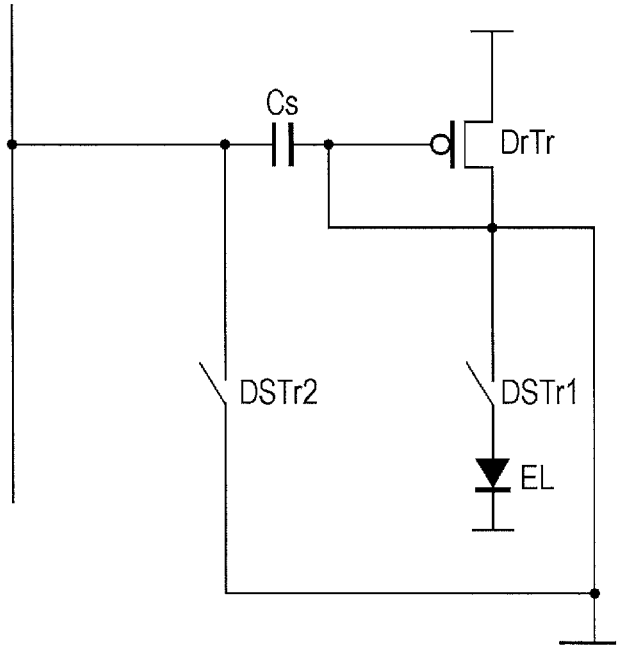
FIG. 2B is an equivalent circuit diagram of a pixel according to the reference.

FIG. 2B is a schematic diagram showing the initializing operation of the pixel circuit 101. During the initializing operation, the switching transistors DSTr1 and DSTr2 are turned off. On the other hand, the remaining transistors including the first and second sampling transistors WSTr1 and WSTr2, and the initializing transistor INITr are turned on. When the first and second sampling transistors WSTr1 and WSTr2 are turned on, the input end of the pixel capacitance Cs is charged with a video signal transmitted from the signal line DTL. On the other hand, when the initializing transistor INITr and the second sampling transistor WSTr2 are turned on, the initializing potential Vini is applied to the gate and the drain of the drive transistor DrTr. Consequently, the potentials of the gate and the drain of the drive transistor DrTr become the same as each other due to the initializing potential Vini so that initialization is performed.

[Threshold Voltage Correction Operation]

Figure 2C:
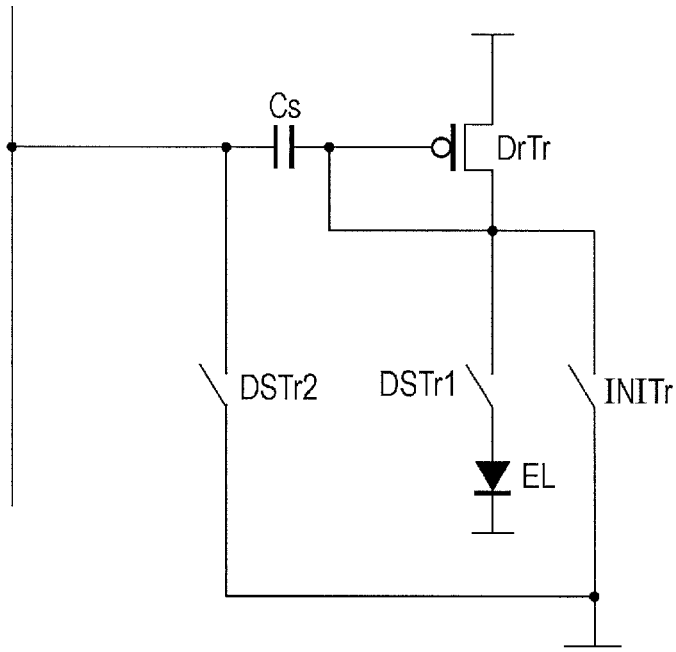
FIG. 2C is another equivalent circuit diagram of the pixel according to the reference.

FIG. 2C shows a threshold voltage correction operation performed by the pixel circuit 101. In this drawing, the initializing transistor INITr is turned off so that fixation of the initial potential Vini being applied to the drain of the drive transistor DrTr is lost. At that time, the gate potential Vg of the drive transistor DrTr is initialized through the initializing potential Vini so that the drive transistor DrTr is turned on. Namely, the initializing potential Vini is set in advance so that the value of the difference between the source potential (VCCP) and the gate potential Vg of the drive transistor DrTr exceeds that of the threshold voltage Vth of the drive transistor DrTr. When the drive transistor DrTr is turned on, a drain current Ids flows from the power potential VCCP, and the pixel capacitance Cs is charged with the drain current Ids. Accordingly, the gate potential Vg of the drive transistor DrTr is increased. The above-described increase is stopped when the value of the difference between the source potential and the gate potential Vg of the drive transistor DrTr attains that of a threshold voltage Vth. The above-described procedures denote the threshold voltage correction operation. The above-described correction operation allows for writing data of a potential used to cancel the threshold voltage Vth of the drive transistor DrTr into the pixel capacitance Cs. The threshold voltage Vth of the drive transistor DrTr is cancelled through the threshold voltage correction operation. Therefore, if the value of the threshold voltage Vth exhibits a variation, no effect is produced due to the variation.

The above-described threshold voltage correction operation is expressed by equations shown below. First, since the drive transistor DrTr is the P-channel transistor, a current obtained in a saturation area is expressed by Equation (1) as below. Here, the sign Ids denotes a current flowing between the drain and the source, the sign Vgs denotes a voltage obtained between the gate and the source, the sign μ denotes mobility, and the sign k denotes a size factor.

$$Ids=k\mu(|Vgs|-Vth)^2 \quad \text{Equation (1)}$$

Since the value of the gate potential Vg is increased to that of the threshold voltage Vth due to the threshold voltage correction operation, the gate potential Vg is expressed by Equation (2) as below, where the sign Vsig denotes a video signal potential.

$$Vg=Vsig-Vth \quad \text{Equation (2)}$$

[Preparatory Operation]

Figure 2D:
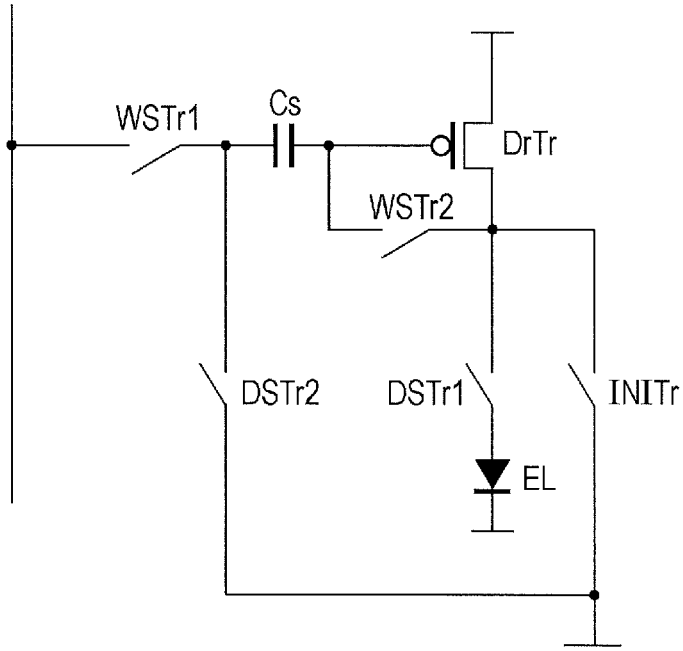
FIG. 2D is another equivalent circuit diagram of the pixel according to the reference.

FIG. 2D indicates an equivalent circuit obtained during the period over which preparations are made for the pixel circuit. During the preparatory period, the first and second sampling transistors WSTr1 and WSTr2 are both turned off. The above-described preparatory period allows for preventing both the first and second sampling transistors WSTr1 and WSTr2 from being turned on due to operations that will be performed later. Consequently, operation failures are reduced.

[Light Emitting Operation]

Figure 2E:
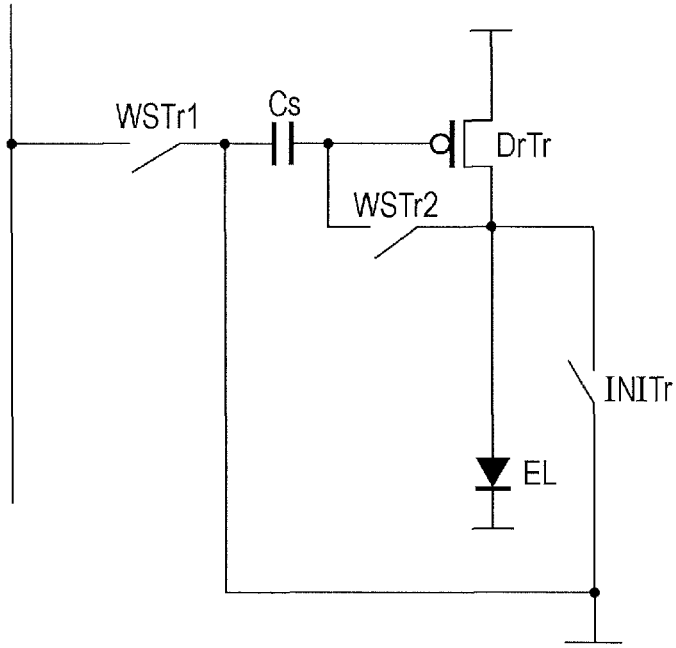
FIG. 2E is another equivalent circuit diagram of the pixel according to the reference.

FIG. 2E is an equivalent circuit diagram expressing the pixel circuit 101 in the light-emitting operation state. In this drawing, the second switching transistor DSTr2 is turned on, and the value of the input-end part of the pixel capacitance Cs charged with the video signal Vsig is changed to that of the initializing potential Vini so that the video signal Vsig is capacitively coupled with the output-end part (that is, the gate part of the drive transistor DrTr) of the pixel capacitance Cs. Further, at the same time as when the second switching transistor DSTr2 is turned on, the first switching transistor DSTr1 is turned on so that the drain of the drive transistor DrTr is connected to the light emitting element EL. Consequently, a drive current Ids flows from the drive transistor DrTr into the light emitting element EL so that the light emitting element EL emits light.

The above-described current is expressed by the following equations. First, the source potential Vs of the drive transistor DrTr is expressed by Equation (3) as below, where the sign Vcc denotes the potential of the power line VCCP.

$$Vs=Vcc \quad \text{Equation (3)}$$

The gate potential Vg is expressed by Equation (2). Since the equation Vgs=Vg−Vs holds, the equation Vgs=Vsig−Vth−Vcc holds based on the Equations (2) and (3). When the sampling potential of the video signal is designated by the sign Vsig and the data potential expressing the light emitting brightness is designated by the sign Vdata, the relationship between the sampling potential and the data potential is expressed by Equation (4) as below.

$$Vsig=Vcc-Vdata \quad \text{Equation (4)}$$

When Equation (4) is substituted into the above-described equation Vgs=Vsig−Vth−Vcc and the equation is readjusted, Equation (5) is obtained as below.

$$|Vgs|=V\text{data}+Vth \quad \text{Equation (5)}$$

When Equation (5) is substituted into Equation (1), Equation (6) is obtained as below.

$$Ids=K\mu(V\text{data})^2 \quad \text{Equation (6)}$$

Thus, it becomes possible to obtain the drive current Ids proportional to the square of the data potential Vdata. Since the Vth term is not included in Equation 6, the drive current Ids flowing into the light emitting element EL is not affected by the threshold voltage Vth of the drive transistor DrTr.

[Control Sequence]

Figure 3A:
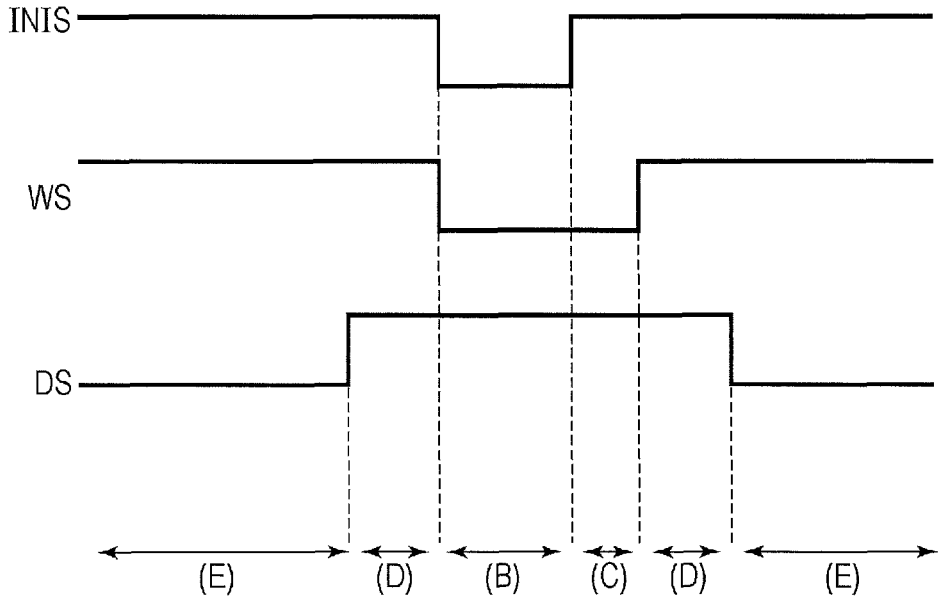
FIG. 3A is a schematic diagram showing an operation sequence according to the reference.

FIG. 3A is a schematic diagram showing the sequence of control pulse signals supplied to the first to third scanning lines. In the above-described schematic diagram, a control pulse signal applied to the first scanning line WSL is designated by the sign WS, a control pulse signal applied to the second scanning line ISL is designated by the sign INIS, and a control pulse signal applied to the third scanning line DSL is designated by the sign DS. As described above, each of the pixel circuits shown in the reference is the P-channel transistor. Therefore, the transistor is in the OFF state when the level of the control pulse signal is high. When the level of the control pulse signal is changed to a low level, the transistor is turned on.

When a light emitting period (E) and a preparatory period (D) come to an end in the previous field, the transistor enters an initializing period (B) over which the level of each of the control pulse signals INIS and WS becomes low while the control pulse signal DS is maintained at a high level. Then, when the transistor enters a threshold voltage correction period (C), the level of the control pulse signal INIS is changed from low to high so that the threshold voltage correction operation shown in FIG. 2C is performed. After that, when the processing advances so that the transistor enters the preparatory period (D), the level of the control pulse signal WS is switched from a low level to a high level. Finally, when the transistor enters a light emitting period (E), the level of the control pulse signal DS is switched from a high level to a low level so that the light emitting operation shown in FIG. 2E is performed.

[Timing Chart]

Figure 3B:
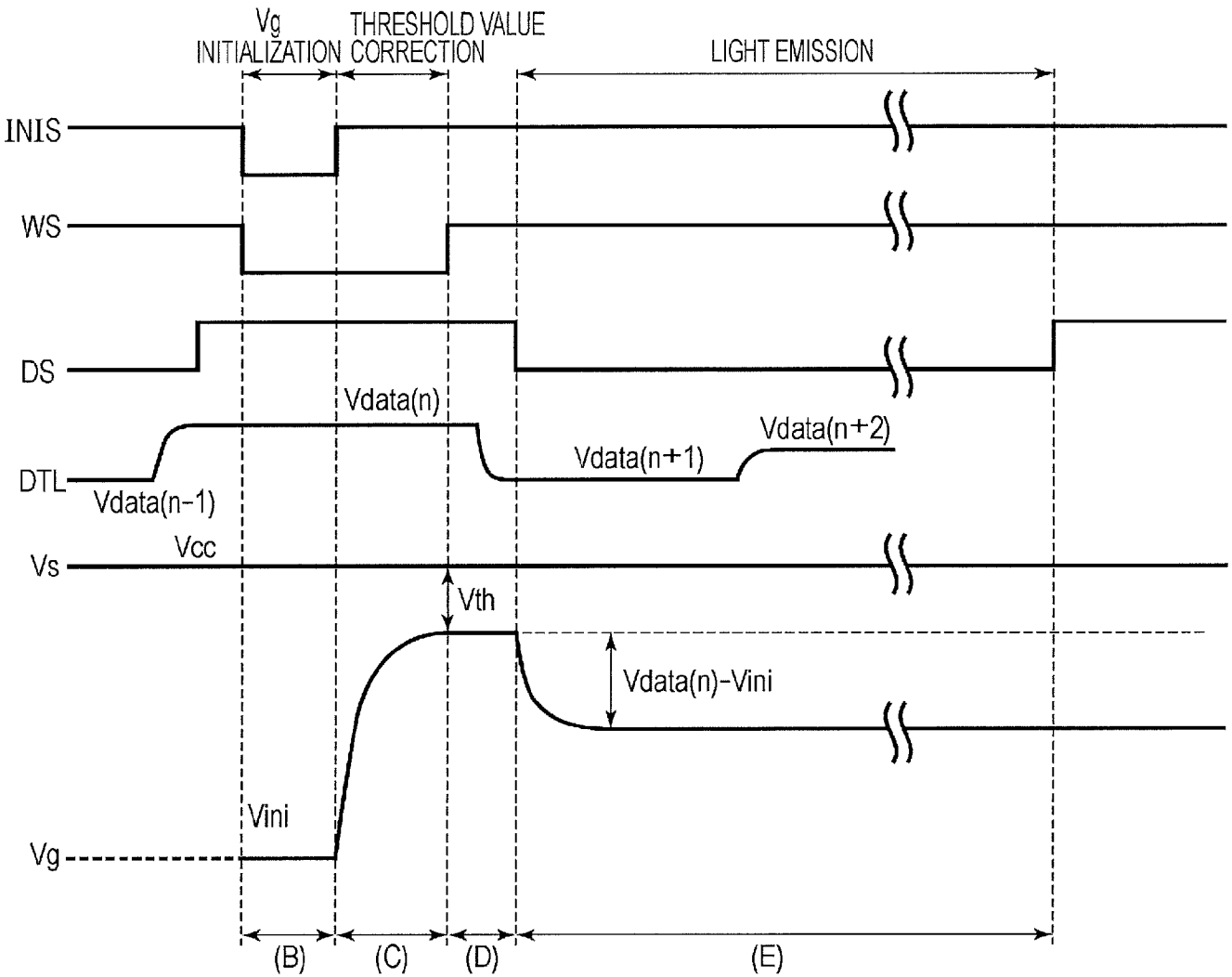
FIG. 3B is a timing chart used to describe operations performed according to the reference.

FIG. 3B is a timing chart showing the waveform of each of the control pulse signals INIS, WS, and DS. In the above-described timing chart, time axes are justified and a change in a signal potential Vdata applied to the signal line DTL is shown. Further, the above-described timing chart shows a change in each of the source potential Vs and the gate potential Vg of the drive transistor DrTr. As described above, the value of the source potential Vs is held at that of the fixed potential Vcc.

First, the level of the control pulse signal INIS becomes low and the initializing transistor INITr is turned on during the initializing period (B), the gate potential Vg of the drive transistor DrTr is initialized to the initializing potential Vini.

Next, when the transistor enters the threshold voltage correction period (C), the control pulse signal INIS is returned to a high level while the control pulse signal WS is held at a low level. Since the drive transistor DrTr is turned on while data of the signal line potential Vsig is written into the source of the drive transistor DrTr, the pixel capacitance Cs is charged with the signal line potential Vsig and the threshold voltage correction operation is performed.

After that, the transistor proceeds and enters the light emitting period (E) so that the level of the control pulse signal DS becomes low and a drive current is flown from the drive transistor DrTr into the light emitting element EL.

Embodiment

[Circuit Configuration]

Figure 4A:
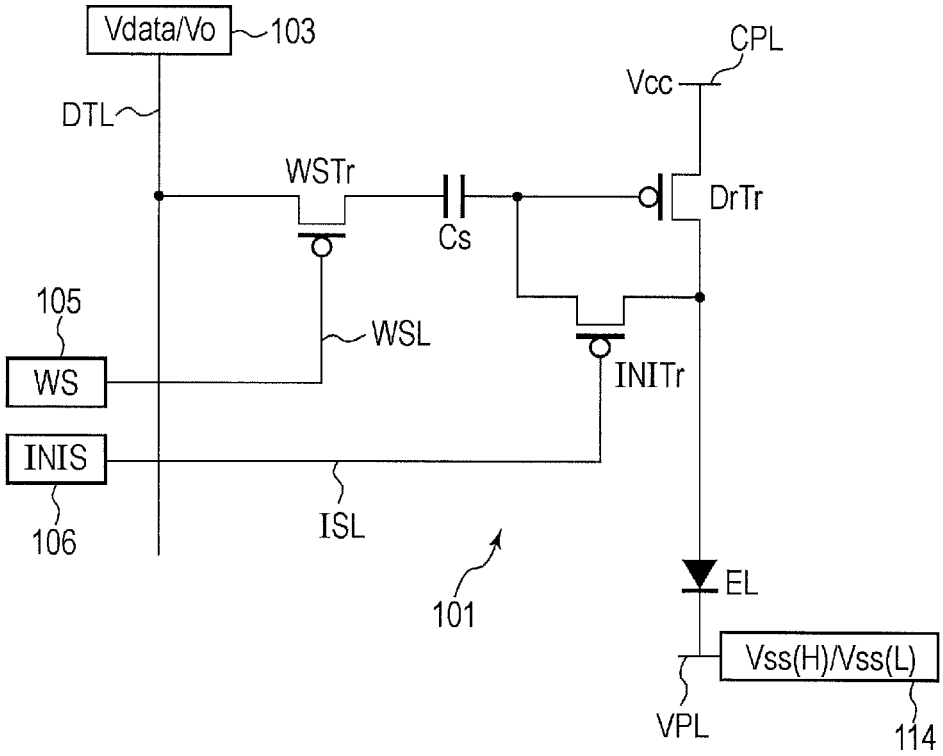
FIG. 4A is a circuit diagram showing a display device and a pixel according to an embodiment of the present invention.

FIG. 4A is a schematic circuit diagram showing the configurations of a display device and a pixel circuit according to an embodiment of the present invention. When compared to the pixel circuit of the reference, which includes six elements, the number of the elements provided in the pixel circuit of the above-described embodiment is three, that is, one-half the number of the elements of the pixel circuit of the reference. Instead of the above-described configuration, a video signal transmitted to the signal line DTL is switched between the signal potential and the reference potential. Further, the cathode potential (power potential) of the light emitting element EL is switched to a binary potential.

A display device according to an embodiment of the present invention basically includes a pixel array portion 102 and a driving portion. The pixel array portion includes a file-like signal line DTL, the first line-like scanning line WSL, the second line-like scanning line ISL, a fixed power line CPL, a variable power line VPL, and pixel circuits 101 arranged in matrix form, where the pixel circuits 101 are provided at parts where the individual signal lines DTL and the individual first scanning lines WSL cross one another.

The drive portion includes a write scanner 105, an initializing scanner 106, a signal driver 103, and a power circuit 114. The write scanner 105 transmits the first control pulse signal WS to each of the first scanning lines WSL. The initializing scanner 106 transmits the second control pulse signal INIS to each of the second scanning lines ISL. The signal driver (horizontal selector) 103 alternately transmits a signal potential Vdata and a reference potential Vo to each of the signal lines DTL. The power circuit 114 switches the variable power line VPL between the first potential Vss (H) and the second potential Vss (L).

The pixel circuit 101 includes a capacitance element (pixel capacitance) Cs, a sampling transistor WSTr, a drive transistor DrTr, an initializing transistor INITr, and a light emitting element EL.

The pixel capacitance Cs includes an input end and an output end. A pair of current ends of the sampling transistor WSTr is connected between the signal line DTL and the input end of the pixel capacitance Cs, and the control end (gate) of the sampling transistor WSTr is connected to the first scanning line WSL. The control end (gate) of the drive transistor DrTr is connected to the output end of the pixel capacitance Cs, and the other current end (source) is connected to a fixed power line CPL. The control end (gate) of the initializing transistor INITr is connected to the second scanning line ISL, and a pair of current ends (source/drain) is connected to the output end of the pixel capacitance Cs and the other current end (drain) of the drive transistor DrTr. The light emitting EL is connected between the variable power line VPL and the other current end (drain) of the drive transistor DrTr. The above-described light emitting element EL is a double-ended element including an anode and a cathode. For example, the above-described light emitting element EL includes an organic electroluminescence (EL) device. The anode is connected to the drain of the drive transistor DrTr while the cathode is connected to the variable power line VPL. Here, the above-described variable power line VPL is provided in parallel with the scanning line WSL. The file-like scanning lines WSL are subjected to line sequential scanning through the write scanner 105. In synchronization with the above-described line sequential scanning, the potential of the line-like variable power line VPL is line-sequentially switched between Vss (H) and Vss (L) through the power circuit 114.

[Write Preparatory Operation and Threshold Voltage Correction Operation]

Figure 4B:
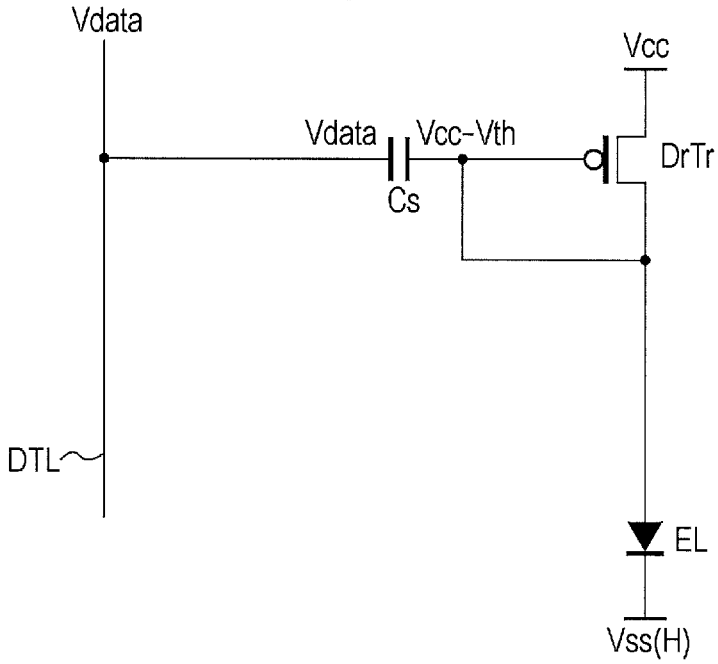
FIG. 4B is an equivalent circuit diagram used to describe operations performed according to the embodiment.

Hereinafter, operations of the above-described display device shown in FIG. 4 will be described in detail. FIG. 4B is an equivalent circuit diagram indicating signal write preparatory/threshold voltage correction operation performed by the above-described display device and the above-described pixel circuit. According to FIG. 4B, the signal potential Vdata is applied to the signal line DTL. The fixed potential Vcc is applied to the fixed power line. The first potential Vss (H) is applied to the variable power line. Then, the sampling transistor WSTr is turned on. Accordingly, the input end of the pixel capacitance Cs is directly connected to the signal line DTL so that the signal potential Vdata is applied to the input end of the pixel capacitance Cs.

On the other hand, the initializing transistor INITr is turned on so that the gate and the drain of the drive transistor DrTr are directly connected to the initializing transistor INITr. Further, the cathode of the light emitting element EL attains the first potential Vss (H). The above-described potential Vss (H) is set to a level where the light emitting element EL enters a reverse bias state. Therefore, the light emitting element EL which is of diode type is in the OFF state. According to the drive transistor DrTr, the drain current Ids is flown from the source maintained at the fixed potential Vcc toward the drain connected to the anode of the light emitting element EL. However, since the light emitting element EL is in the reverse bias state, the drain current Ids is not flown to the cathode part of the light emitting element EL. The above-described current is flown toward the output end part of the pixel capacitance Cs (that is, the gate part of the drive transistor DrTr). When the value of the potential Vgs obtained between the source and the gate of the drive transistor DrTr attains that of the threshold voltage Vth, the drive transistor DrTr is cut off. The potential Vg of the gate of the drive transistor DrTr (the output end of the pixel capacitance Cs) is expressed as Vcc−Vth due to the above-described operations.

[Write Operations of Signal Potential]

Figure 4C:
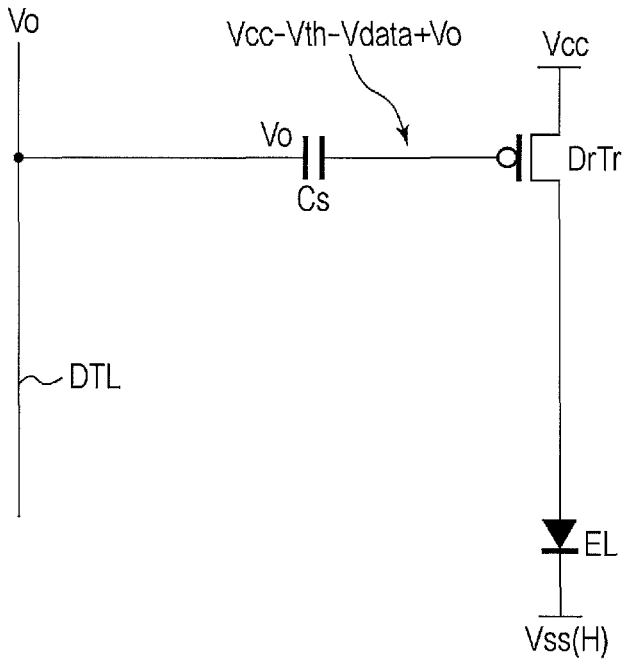
FIG. 4C is another equivalent circuit diagram used to describe operations performed according to the embodiment.

FIG. 4C is an equivalent circuit diagram indicating signal write operations performed by the pixel circuit. Shifting from the threshold voltage correction operation shown in FIG. 4B to the signal write operation allows for turning the initializing transistor INITr off and separating the gate and the drain of the drive transistor DrTr from each other. In the above-described state, the potential of the signal line DTL is switched from the signal potential Vdata to the reference potential Vo. The potential of the input end of the pixel capacitance Cs is changed from the potential Vdata to the reference potential Vo. Due to the above-described potential change, coupling enters from the input end of the pixel capacitance Cs toward the output end of the pixel capacitance Cs and data is written into the gate of the drive transistor DrTr. Namely, the gate potential Vg of the drive transistor DrTr is expressed as Vcc−Vth−Vdata+Vo.

[Light Emitting Operation]

Figure 4D:
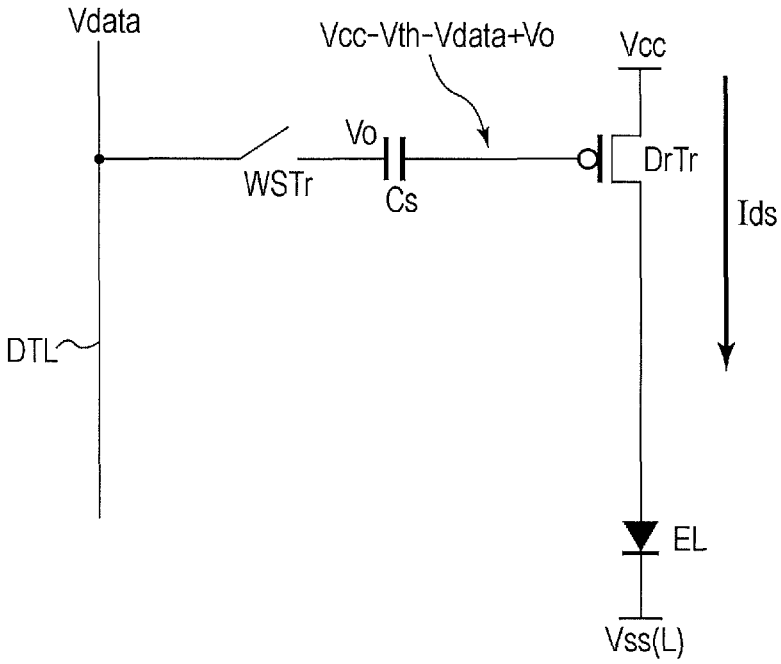
FIG. 4D is another equivalent circuit diagram used to describe operations performed according to the embodiment.

FIG. 4D is an equivalent circuit diagram indicating the light emitting operation of the pixel circuit. When moving from the signal write operation shown in FIG. 4C to the light emitting operation, the sampling transistor WSTr is turned off and the input end of the pixel capacitance Cs is cut off from the signal line DTL. Consequently, the value of the gate potential Vg of the drive transistor DrTr is maintained at that expressed as Vcc−Vth−Vdata+Vo without being affected by the potential change attained on the signal-line-DTL side. Of the terms of the gate potential Vg, the first two terms (Vcc−Vth) are threshold voltage cancellation terms, and the last two terms (−Vdata+Vo) denote data stipulating the light-emitting brightness. In that state, the potential of the cathode side of the light-emitting element EL is downwardly changed from the first potential Vss (H) to the second potential Vss (L). Consequently, the reverse bias state of the light emitting element EL is cancelled so that the light emitting element EL enters the forward bias state. Consequently, the drive current Ids flows from the drive transistor DrTr into the light emitting element EL so that the light emitting element EL emits light having predetermined brightness. The drive current Ids is determined based on the gate voltage Vgs of the drive transistor DrTr, where the numerical expression Vgs=Vcc−(Vcc−Vth−Vdata+Vo)=Vth+Vdata−Vo holds. A net signal component is expressed as the terms Vdata−Vo. Namely, the difference between the signal potential Vdata and the reference potential Vo denotes the net signal component.

[Lights-Out Operation]

Figure 4E:
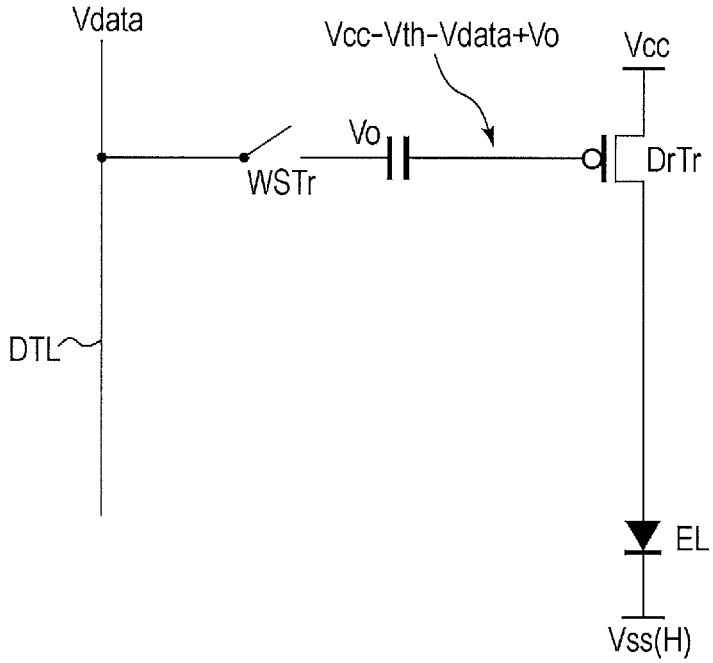
FIG. 4E is another equivalent circuit diagram used to describe operations performed according to the embodiment.

After shifting from the light emitting period shown in FIG. 4D to a non-light emitting period, a lights-out operation shown in FIG. 4E is performed. The rate of what is held by a light emitting time in a single field and/or a single frame denotes a duty. The screen brightness can be adjusted by changing the duty. During the lights-out operation, the cathode potential of the light emitting element EL is upwardly changed from the second potential Vss (L) to the first potential Vss (H). Consequently, the light emitting element EL returns to the reverse bias state where no drive current Ids is flown. Therefore, the light emitting element EL is switched from the lights-up state to the lights-out state. On the other hand, the gate potential Vg of the drive transistor DrTr is still held at the state expressed by the numerical expression Vcc−Vth−Vdata+Vo. Since the value of the gate voltage Vgs of the drive transistor DrTr exceeds that of the threshold voltage Vth, the drive transistor DrTr is held at the ON state in the lights-out state. After that, a shift to the next field and/or the next frame is made so that the threshold voltage correction operation shown in FIG. 4B is performed again.

[Timing Chart]

Figure 4F:
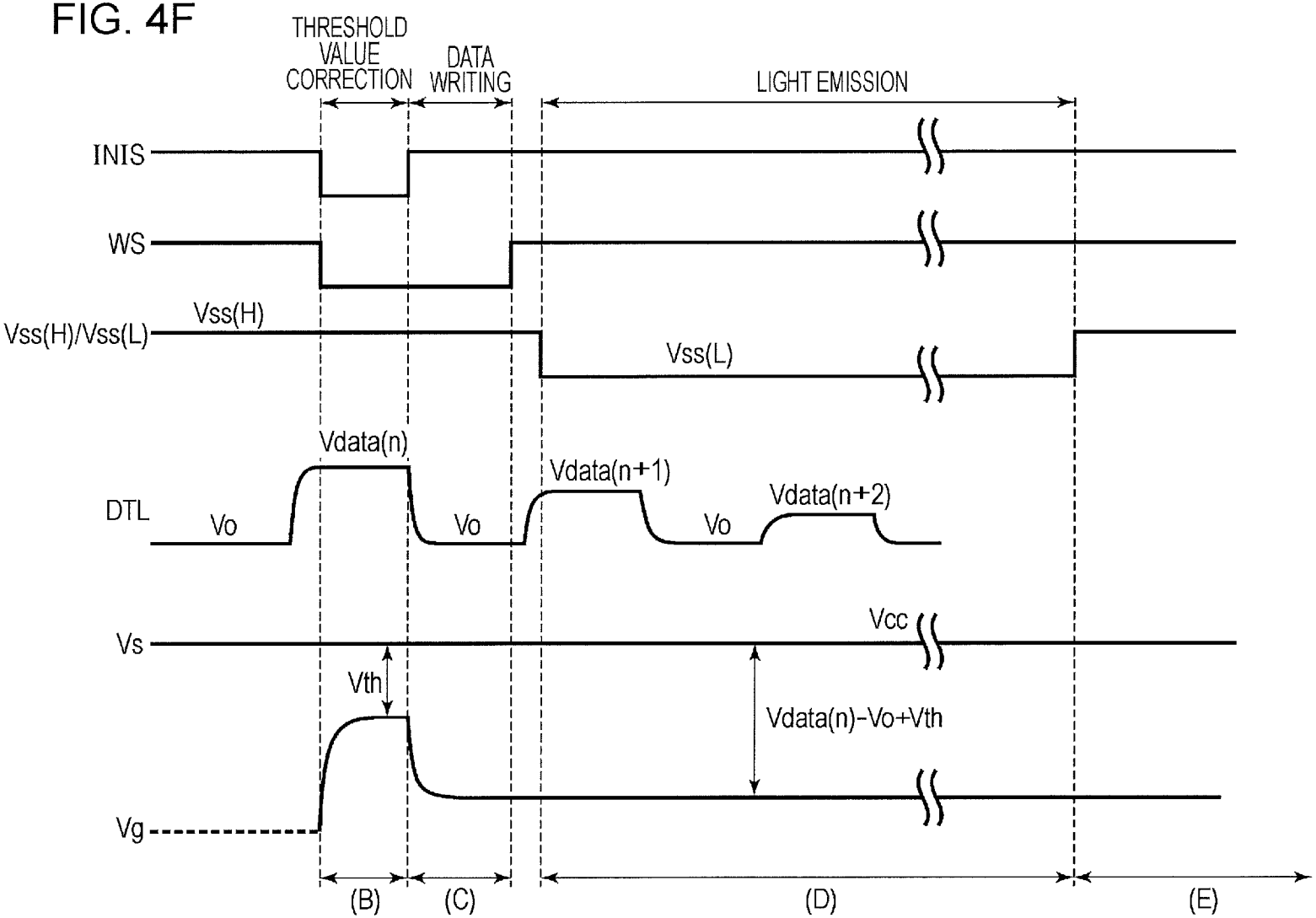
FIG. 4F is a timing chart used to describe operations performed according to the embodiment.

FIG. 4F is a timing chart used to illustrate operations of the above-described display device and pixel circuit that are shown in FIG. 4A. In the above-described timing chart, time axes are justified and a change in each of the waveforms of the control pulse signal INIS and the control pulse signal WS is shown. In synchronization with the above-described waveform change, a change in the potential Vss (H) and/or the potential Vss (L) of the variable power line is shown. Further, a change in the potential of the signal line DTL is shown. The potential of the signal line DTL is switched from the potential Vdata to the reference potential Vo within a single horizontal cycle. Further, a change in each of the source potential Vs and the gate potential Vg of the drive transistor DrTr is also shown. As described above, the source potential Vs is held at the fixed potential Vcc at all times. On the other hand, the gate potential Vg is changed in each of the threshold voltage correction period (B), the signal writing period (C), the light emitting period (D), and a non-light emitting period (E) as shown in FIG. 4F.

During the threshold voltage correction period (B), the signal line DTL enters a signal potential Vdata (n) and the variable power line is held at the first potential Vss (H). At that time, the sampling transistor WSTr is turned on in response to the first control pulse signal WS and the signal potential Vdata is written on the input-end part of the capacitance element Cs. At the same time, the initializing transistor INITr is turned on in response to the second control pulse signal INIS and data of a potential provided to cancel the threshold voltage Vth of the drive transistor DrTr is written onto the output-end part of the capacitance element Cs.

Next, when a shift to the signal writing period (C) is made, the initializing transistor INITr is turned off while the potential of the single line DTL is switched from the signal potential Vdata (n) to the reference potential Vo while the sampling transistor WSTr is held at the ON state. Consequently, capacitive coupling occurs and the signal potential Vdata (n) is written from the input-end part to the output-end part of the capacitance element Cs.

Next, when a shift to the light emitting period (D) is made, the sampling transistor WSTr is turned off and the potential of the variable power line is switched from the first potential Vss (H) to the second potential Vss (L) so that the light emitting element EL emits light.

Then, if a shift to the non-light emitting period (E) is made, the potential of the variable power line is switched from the second potential Vss (L) to the first potential Vss (H). Consequently, the state of the light emitting element EL is changed from the light emitting state to the non-light emitting state.

[Application]

Figure 5:
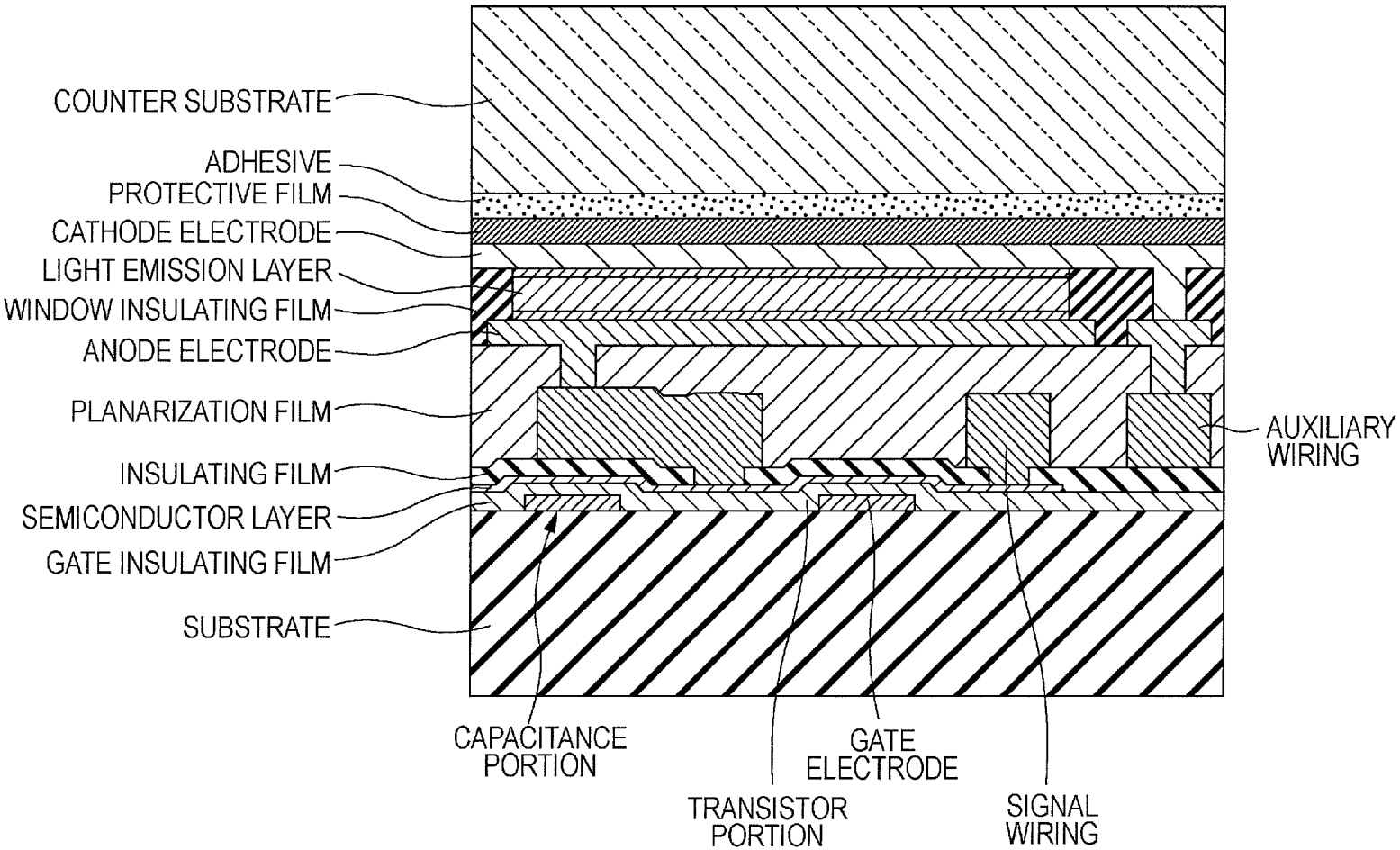
FIG. 5 is a cross-sectional view of the device configuration of a display device according to an application of the present invention.

A display device according to an embodiment of the present invention includes an exemplary thin film device configuration shown in FIG. 5. A thin-film-transistor (TFT) portion shown in FIG. 5 has a bottom gate configuration (where a gate electrode is provided under a channel PS layer). In addition, the TFT portion may have various configurations including a sandwich gate configuration (where the channel PS layer is sandwiched between gate electrodes provided on and under the channel PS layer), a top gate configuration (where the gate electrode is provided on the channel PS layer), and so forth. FIG. 5 shows a schematic cross-sectional configuration of a pixel provided on an insulating substrate. As shown in FIG. 5, the pixel includes a transistor portion including a plurality of thin-film transistors (a single TFT is exemplarily shown in FIG. 5), a capacitance portion including a pixel capacitance, and a light emitting portion including an organic EL device or the like. The transistor portion and/or the capacitance portion is provided on the substrate through a TFT process, and the light emitting portion including the organic EL device or the like are stacked on the transistor portion and/or the capacitance portion. A transparent counter substrate is affixed onto the light emitting portion via an adhesive so that a flat panel is achieved.

Figure 6:
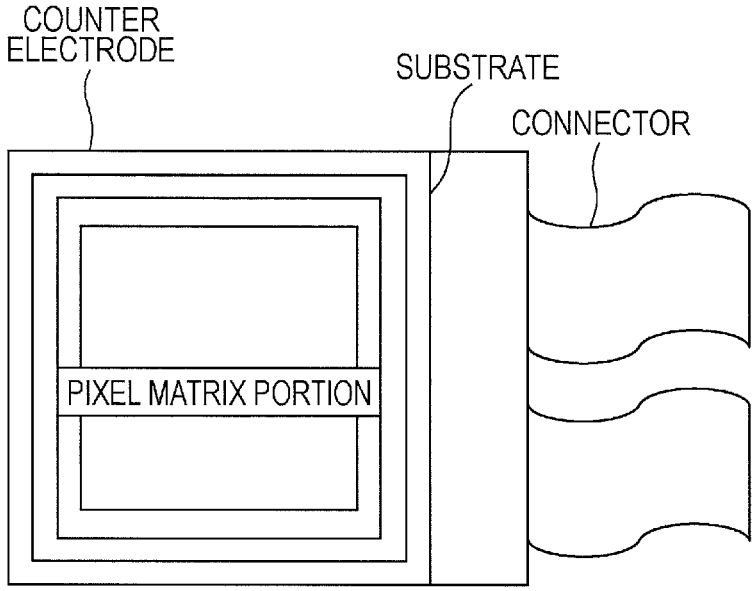
FIG. 6 is a plan view of the module configuration of the display device according to the application.

A display device according to an embodiment of the present invention includes a flat and module-shaped display device as shown in FIG. 6. For example, a pixel array portion including pixels that are integrated onto an insulating substrate in matrix form is provided, where each of the pixels includes an organic EL device, a thin film transistor, a thin-film capacitance, and so forth. Then, an adhesive is provided around the pixel array portion (pixel matrix portion) and a counter substrate including glass or the like is affixed onto the pixel array portion so that a display module is attained. A color filter, a protective film, a light shield film, and so forth may be provided for the above-described transparent counter substrate as appropriate. The display module may include a flexible print circuit (FPC) as a connector provided to externally input and/or output a signal or the like to and/or from the pixel array portion.

The above-described display apparatus, which is flat-panel shaped, can be used for various electronic devices and/or apparatuses including a digital camera, a note-type personal computer, a mobile phone, a video camera, and so forth. The display device can be used for the displays of electronic appliances of all fields, where each of the displays can display a drive signal that is transmitted to an electronic device and/or generated in the electronic device as an image and/or video. Hereinafter, an exemplary electronic appliance including the above-described display device will be described. The electronic appliance basically includes a main body configured to process information and a display unit displaying information transmitted to the main body and/or information transmitted from the main body.

Figure 7:
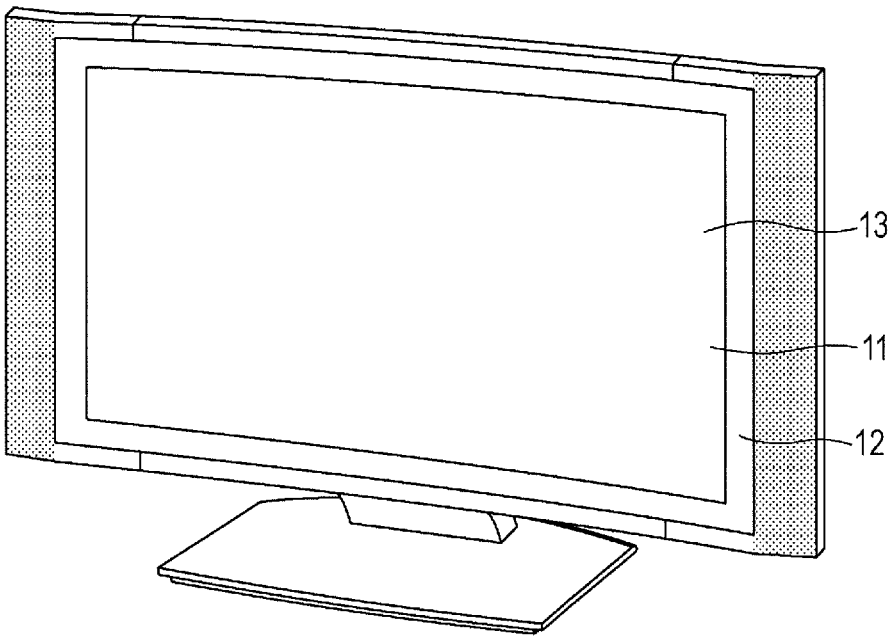
FIG. 7 is a perspective view of a television set including the display device according to the application.

FIG. 7 is a television (TV) set according to an embodiment of the present invention. The TV set has a video display screen 11 including a front panel 12, a filter glass plate 13, and so forth. The TV set is attained by using a display device according to an embodiment of the present invention for the video display screen 11.

Figure 8A:
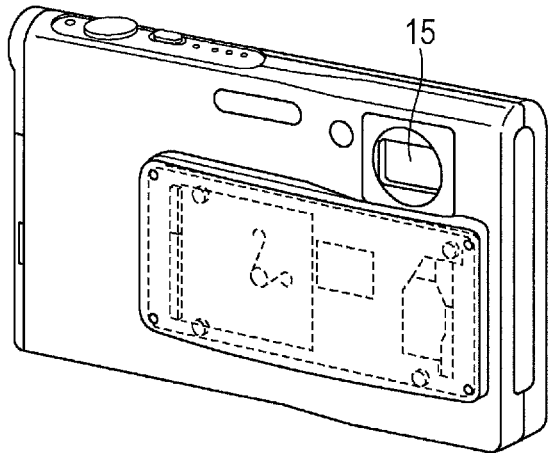
FIG. 8 is a perspective view of a digital still camera including the display device according to the application.
Figure 8B:
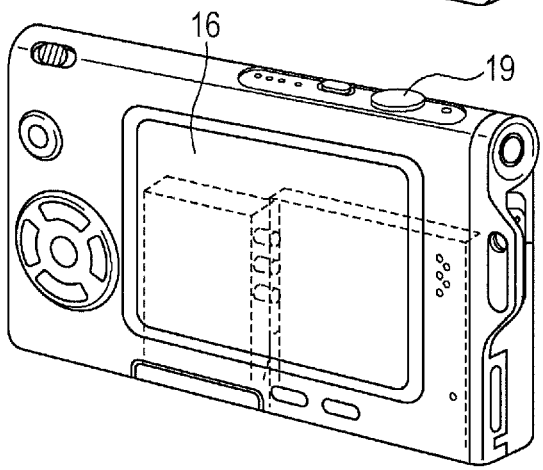

FIG. 8 is a digital camera according to an embodiment of the present invention. The upper portion and the lower portion of FIG. 8 individually show a front face and a back face of the digital camera including an imaging lens, a light emitting unit 15 used for a flash, a display unit 16, a control switch, a menu switch, a shutter 19, and so forth. The digital camera is attained by using a display device according to an embodiment of the present invention for the display unit 16.

Figure 9:
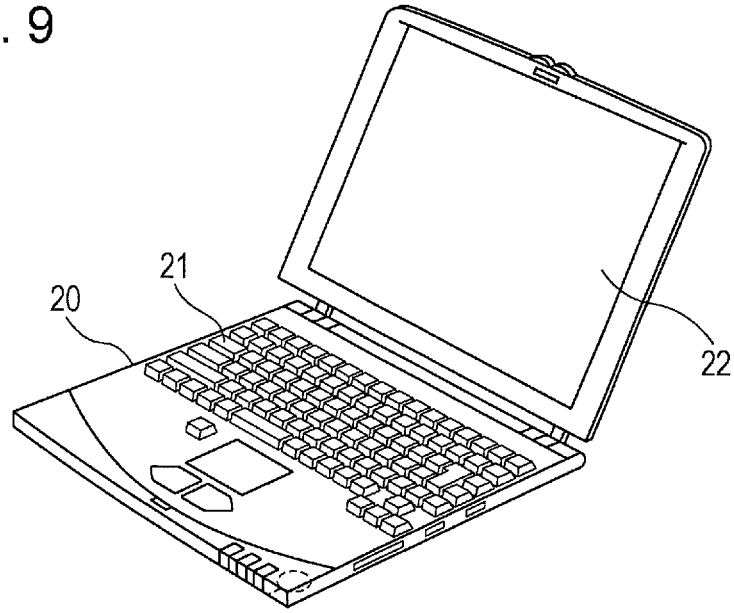
FIG. 9 is a perspective view of a note-type personal computer including the display device according to the application.

FIG. 9 is a note-type personal computer according to an embodiment of the present invention. A main body 20 includes a keyboard 21 operated for inputting data of characters or the like. A main-body cover includes a display part 22 provided to display an image. The personal computer is attained by using a display device according to an embodiment of the present invention for the display part 22.

Figure 10A:
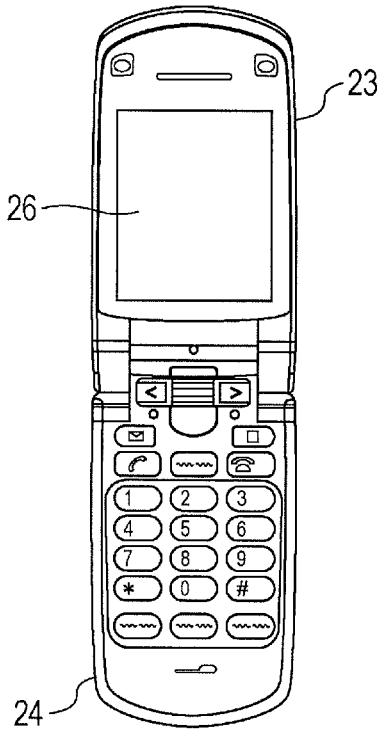
FIG. 10 is a schematic diagram of a mobile terminal device including the display device according to the application.
Figure 10B:
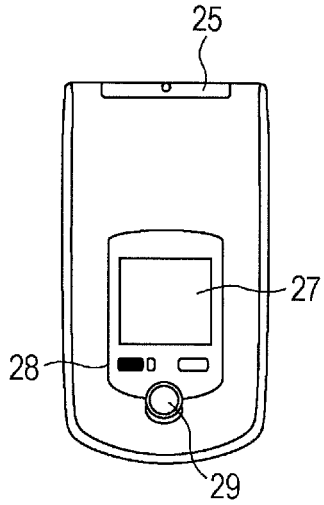

FIG. 10 is a mobile terminal device according to an embodiment of the present invention. The left part and the right part of the mobile terminal device individually show the mobile terminal device which is left open and the mobile terminal device which is left closed. The above-described mobile terminal device includes an upper housing 23, a lower housing 24, a coupling part (hinge part in this specification) 25, a display 26, a sub display 27, a picture light 28, a camera 29, and so forth. The mobile terminal device is attained by using a display device according to an embodiment of the present invention for the display 26 and/or the sub display 27.

Figure 11:
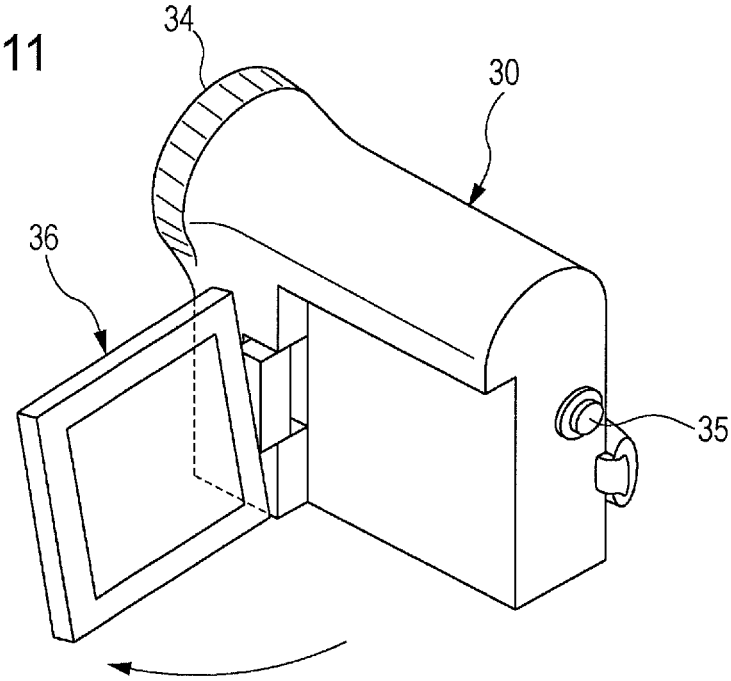
FIG. 11 is a perspective view of a video camera including the display device according to the application.

FIG. 11 shows a video camera according to an embodiment of the present invention, where the video camera includes a main body 30, a lens 34 used to capture the image of a subject, where the lens 34 is provided on the side face facing forward, a start/stop switch 35 used at the image capturing time, a monitor 36, and so forth. The video camera is attained by using a display device according to an embodiment of the present invention for the monitor 36.

The present application contains subject matter related to that disclosed in Japanese Priority Patent Application JP 2008-286782 filed in the Japan Patent Office on Nov. 7, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A pixel circuit provided on a substrate on which a signal line in which a signal potential and a reference potential are alternately switched, a fixed power line, and a variable power line switched between a first potential and a second potential are arranged, the pixel circuit comprising:

a capacitance element;

a sampling transistor connected between the signal line and a first terminal of the capacitance element;

a drive transistor connected to the fixed power line;

an initializing transistor connected between a second terminal of the capacitance element and the drive transistor; and a light emitting element connected between the variable power line and the drive transistor, wherein when the variable power line is held at the first potential, the signal potential is supplied to the first terminal of the capacitance element via the sampling transistor while the initializing transistor is turned on, wherein the initializing transistor is turned off while the reference potential is supplied to the first terminal of the capacitance element via the sampling transistor, and wherein the sampling transistor is turned off while the variable power line is switched from the first potential to the second potential.

2. A display device including a pixel circuit provided on a substrate on which a signal line in which a signal potential and a reference potential are alternately switched, a fixed power line, and a variable power line switched between a first potential and a second potential are arranged, the pixel circuit comprising:

a capacitance element;

a sampling transistor connected between the signal line and a first terminal of the capacitance element;

a drive transistor connected to the fixed power line;

an initializing transistor connected between a second terminal of the capacitance element and the drive transistor; and a light emitting element connected between the variable power line and the drive transistor, wherein when the variable power line is held at the first potential, the signal potential is supplied to the first terminal of the capacitance element via the sampling transistor while the initializing transistor is turned on, wherein the initializing transistor is turned off while the reference potential is supplied to the first terminal of the capacitance element via the sampling transistor, and wherein the sampling transistor is turned off while the variable power line is switched from the first potential to the second potential.

3. The display device according to claim 2, wherein a gate electrode of the drive transistor is provided under a channel layer of the drive transistor.

4. The display device according to claim 2, wherein a plurality of gate electrodes of the drive transistor are provided under and on a channel layer of the drive transistor.

5. The display device according to claim 2, wherein a gate electrode of the drive transistor is provided on a channel layer of the drive transistor.

6. The display device according to claim 2, wherein the pixel circuit includes a transistor portion including a plurality of thin-film transistors, a capacitance portion including the capacitance element, and a light emitting portion including the light emitting element, wherein the transistor potion and the capacitance portion are provided on a substrate, and the light emitting portion is stacked on the transistor portion and the capacitance portion.

7. The display device according to claim 6, wherein a transparent counter substrate is affixed onto the light emitting portion via an adhesive.

* * * * *